US007357137B2

(12) United States Patent
Husband et al.

(10) Patent No.: US 7,357,137 B2
(45) Date of Patent: Apr. 15, 2008

(54) DEVICE FOR DISPENSING A BARRIER MATERIAL TO A LOCK OF HAIR

(75) Inventors: Peter Antony Husband, Ashover (GB); Paul Leslie Barrass, Camberley (GB); Paul Laurence Brennan, London (GB); Jonathan Norman Robert Hodges, Windsor (GB); Delyth Angharad James, Egham (GB)

(73) Assignee: The Procter & Gamble Company, Cincinnati, OH (US)

( * ) Notice: Subject to any disclaimer, the term of this patent is extended or adjusted under 35 U.S.C. 154(b) by 71 days.

(21) Appl. No.: 10/930,176

(22) Filed: Aug. 31, 2004

(65) Prior Publication Data

US 2005/0028835 A1 Feb. 10, 2005

Related U.S. Application Data

(63) Continuation of application No. PCT/US2004/015050, filed on May 14, 2004.

(30) Foreign Application Priority Data

May 14, 2003 (EP) ..... 03252977

(51) Int. Cl.

| | |
|---|---|
| ***A45D 19/18*** | (2006.01) |
| ***A45D 37/00*** | (2006.01) |
| ***A61Q 7/00*** | (2006.01) |
| ***B65D 85/02*** | (2006.01) |

(52) U.S. Cl. ..... 132/270; 132/221; 132/202; 242/588.6

(58) Field of Classification Search ..... 132/202, 132/270, 221, 222, 212, 333; 225/25, 26, 225/34, 77, 90, 37, 38, 39, 46, 47; 242/588.3, 242/588.6

See application file for complete search history.

(56) References Cited

U.S. PATENT DOCUMENTS

| | | | | |
|---|---|---|---|---|
| 2,107,603 A * | 2/1938 | Ellenburg | ..... | 242/588.3 |
| 2,655,924 A | 10/1953 | Petitta | | |
| 2,819,721 A | 1/1958 | Zakon | | |
| 3,132,783 A * | 5/1964 | Colin | ..... | 225/25 |

(Continued)

FOREIGN PATENT DOCUMENTS

| | | |
|---|---|---|
| DE | 4041742 A1 | 6/1992 |

(Continued)

*Primary Examiner*—Robyn Doan
*Assistant Examiner*—Rachel A. Running
(74) *Attorney, Agent, or Firm*—Marianne Dressman; Idris N. McKelvey; Melissa Krasovec

(57) ABSTRACT

A hand-held device (2) for applying a barrier material (4, 6) to a lock of hair to be treated with a highlighting composition (32) is disclosed. The device may comprise one or two rolls (8, 10) of a tape of barrier material (4, 6) that is dispensed to the lock of hair as the same time as the roll or rolls (8, 10) are unrolled. The device may also contain the highlighting composition (32), either applied on the rolled tape or via a reservoir contained in the body.

15 Claims, 8 Drawing Sheets

U.S. PATENT DOCUMENTS

| | | | | | |
|---|---|---|---|---|---|
| 3,283,886 | A | * | 11/1966 | Addis et al. | 242/588.6 |
| 3,310,167 | A | * | 3/1967 | Knox | 242/593 |
| 4,461,668 | A | | 7/1984 | Samuelsen | |
| 4,546,879 | A | | 10/1985 | Viscasillas | |
| 4,576,311 | A | | 3/1986 | Horton | |
| 4,655,377 | A | * | 4/1987 | Orangeo et al. | 225/48 |
| 4,723,723 | A | | 2/1988 | Asahi | |
| 4,735,351 | A | * | 4/1988 | Biswas | 225/25 |
| 5,146,937 | A | | 9/1992 | Lefebvre | |
| 5,482,182 | A | | 1/1996 | Thompson | |
| 5,678,689 | A | | 10/1997 | Clark et al. | |
| 5,806,714 | A | * | 9/1998 | Geiger | 221/73 |
| 5,845,653 | A | | 12/1998 | Abercrombie | |
| 5,888,249 | A | | 3/1999 | Laurila et al. | |
| 5,888,484 | A | | 3/1999 | Schmitt et al. | |
| D411,859 | S | | 7/1999 | Whitmore | |
| 5,931,168 | A | * | 8/1999 | Abercrombie et al. | 132/208 |
| 6,029,849 | A | * | 2/2000 | Meshulam | 221/26 |
| 6,237,608 | B1 | | 5/2001 | Kari | |
| D446,246 | S | | 8/2001 | Kimura | |
| D448,415 | S | | 9/2001 | Huang | |
| 6,364,245 | B1 | * | 4/2002 | Paal et al. | 242/560 |
| 6,613,144 | B1 | | 9/2003 | Loertscher et al. | |
| 6,694,667 | B2 | * | 2/2004 | Davis | 43/54.1 |

FOREIGN PATENT DOCUMENTS

| | | |
|---|---|---|
| JP | 10117836 | 5/1998 |
| JP | 1128367 | 10/1999 |
| WO | WO-98/14393 A1 | 4/1998 |

* cited by examiner

DEVICE FOR DISPENSING A BARRIER MATERIAL TO A LOCK OF HAIR

CROSS REFERENCE TO RELATED APPLICATION

The application is a continuation of International application PCT/US2004/015050 filed on May 14, 2004.

FIELD OF THE INVENTION

The present invention relates to hair highlighting, in particular to devices and methods for dispensing at least one barrier material, preferably in the form of one or more tapes, to a lock of hair to be highlighted. The barrier material protects the neighboring hair and the user's clothes from the highlighting composition that may be applied on the lock of hair being highlighted.

BACKGROUND OF THE INVENTION

Hair highlighting has been one of the mainstays of the professional salon industry. In this process, one or more locks of hair are usually segregated from the remainder and treated with a "highlighting" composition, which typically comprises peroxides and/or persulfates. The technical skill required to separate the target hair and mix and apply highlighting products to only those areas has kept this procedure mostly in the purview of hair salons. Previously, the segregation of hair was done by applying a plastic cap over the head and drawing small sections of hair through it.

More commonly now, hair is selected through weaving and then placed onto metallic foils (usually aluminum foil) that are then painted with the highlighting composition. This allows for smaller, more independent sections to be treated, resulting in a more natural highlighted look. Although the effect is visually more appealing, these procedures are time consuming and generally require the skill of a professional haircolorist. Salons charge accordingly—often in excess of 100 USD per service. A dispensing device for metallic foil that may be used in highlighting process is disclosed in U.S. Pat. No. 6,237,608.

Commonly, hair salons use high lift powdered bleaches for highlighting effects. High lift bleaches, using combinations of sodium, potassium, and ammonium persulfate along with hydrogen peroxide at elevated pH, provide fast decolorization with an acceptable amount of hair damage. Up to seven levels of lift are possible using a single application of some off-the-scalp bleaches. These are difficult to use due to the need to combine the persulfate mixture with the peroxide immediately prior to use. The high volume peroxide may be irritating to skin and mucous membranes. The persulfate powders are dusty and can be irritating if inhaled. This procedure is also limited by the technology in that the metallic foils need to be opened periodically to determine the degree of decoloration. Thus despite the high demand for these effects, high lift treatments are relegated to a small corner of the at-home consumer market.

Hydrogen peroxide solutions have been formulated into hair lightening products for consumer use. Products such as SUN IN (RTM), A TOUCH OF SUN (RTM), and most recently SALON SELECTIVES LIGHTEN UP HIGHLIGHTING MOUSSE (RTM) have been introduced to give consumers a gradual highlighting effect. Hydrogen peroxide is unstable for storage at elevated pH (generally greater than pH 4.0) and the decolorizing effect of it at low pH is relatively weak. Therefore multiple applications of low pH products applied repeatedly over time are required to achieve a desired lightening effect. Further, these are whole-head lightening effects. Further examples of bleaching compositions are disclosed in U.S. Pat. No. 5,888,484 and U.S. Pat. No. 5,888,249.

The highlighting composition used, whatever its type, should be carefully applied on the locks of hair to be treated and should not spread or leak to adjacent sections of hair. Leaking of the highlighting composition is likely to compromise the overall resulting look and may also stain the user's clothes.

In addition to the aluminum foil discussed above, various systems have been proposed for preventing leaking of the composition. For example U.S. Pat. No. 5,845,653 and U.S. Pat. No. 5,931,168 disclose applicators for transferring color-altering material from a rigid substrate to hair or fibers.

Methods have also been proposed in which the strands of hair to be colored are pulled inside a tube, for example using a hooked device, the tube being then filled with a dye or bleach composition. These and other systems have been described in the patent literature, see for example U.S. Pat. No. 2,655,924, U.S. Pat. No. 2,819,721, U.S. Pat. No. 5,146,937.

However none of the systems proposed until now have proven entirely satisfactory and there is still a need for an easy to use, non-messy, quick and/or cheaper system for dispensing a barrier material between a lock of hair to be highlighted and its environment (e.g. the rest of the hair, the user's hands or clothes).

Tape dispensing devices are known, but have rarely been used in the hair care field. Examples of documents disclosing tape dispensing devices in a non-hair care environment are U.S. Pat. No. 4,461,668, U.S. Pat. No. 4,546,879, U.S. Pat. No. 5,482,182, U.S. Pat. No. 4,576,311, U.S. Pat. No. 4, U.S. Pat. No. D448,415, U.S. Pat. No. D446,246, U.S. Pat. No. D411,859, WO98/14393

SUMMARY OF THE INVENTION

The present invention is directed to a hand-held device for dispensing a barrier material to a lock of hair to be treated with a highlighting composition, said device comprising i) a body, said body comprising holding means for allowing the user to hold and manipulate the device, ii) a first roll of a tape of barrier material rotatably connected to said body, iii) a second roll of a tape of barrier material rotatably connected to said body, and iv) at least one dispensing means for dispensing said first and second tapes of barrier material to said lock of hair, wherein said first and second tapes of barrier material can be unrolled and dispensed simultaneously.

The present invention is further directed to a hand-held device for dispensing a barrier material to a lock of hair to be treated with a highlighting composition, said device comprising:

i) a body, said body comprising holding means for allowing the user to hold and manipulate the device, ii) a single roll of a tape of barrier material rotatably connected to said body, iii) dispensing means for dispensing said single tape of barrier material to said lock of hair, wherein said single tape of barrier material can be unrolled and dispensed simultaneously, the tape being preferably foldable over the lock of hair to be treated.

The present invention is further directed to a method for dispensing a tape of barrier material to a lock of hair to be highlighted, said method comprising the steps of:

i) dispensing the highlighting composition to the lock of hair, ii) simultaneously unrolling and dispensing to the lock of hair one or more tapes of barrier material, wherein step i) and ii) can take place simultaneously or subsequently.

A further step may include wrapping or enclosing said lock of hair in said one or more tapes of barrier material.

These and other features, aspects, and advantages of the present invention will become evident to those skilled in the art from a reading of the present disclosure.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and in which:

FIG. 9 is a perspective cut-away view showing how the tape of barrier material and the backing tape separate in the upper jaw of the device of FIG. 8.

DETAILED DESCRIPTION OF THE INVENTION

Figure 1:
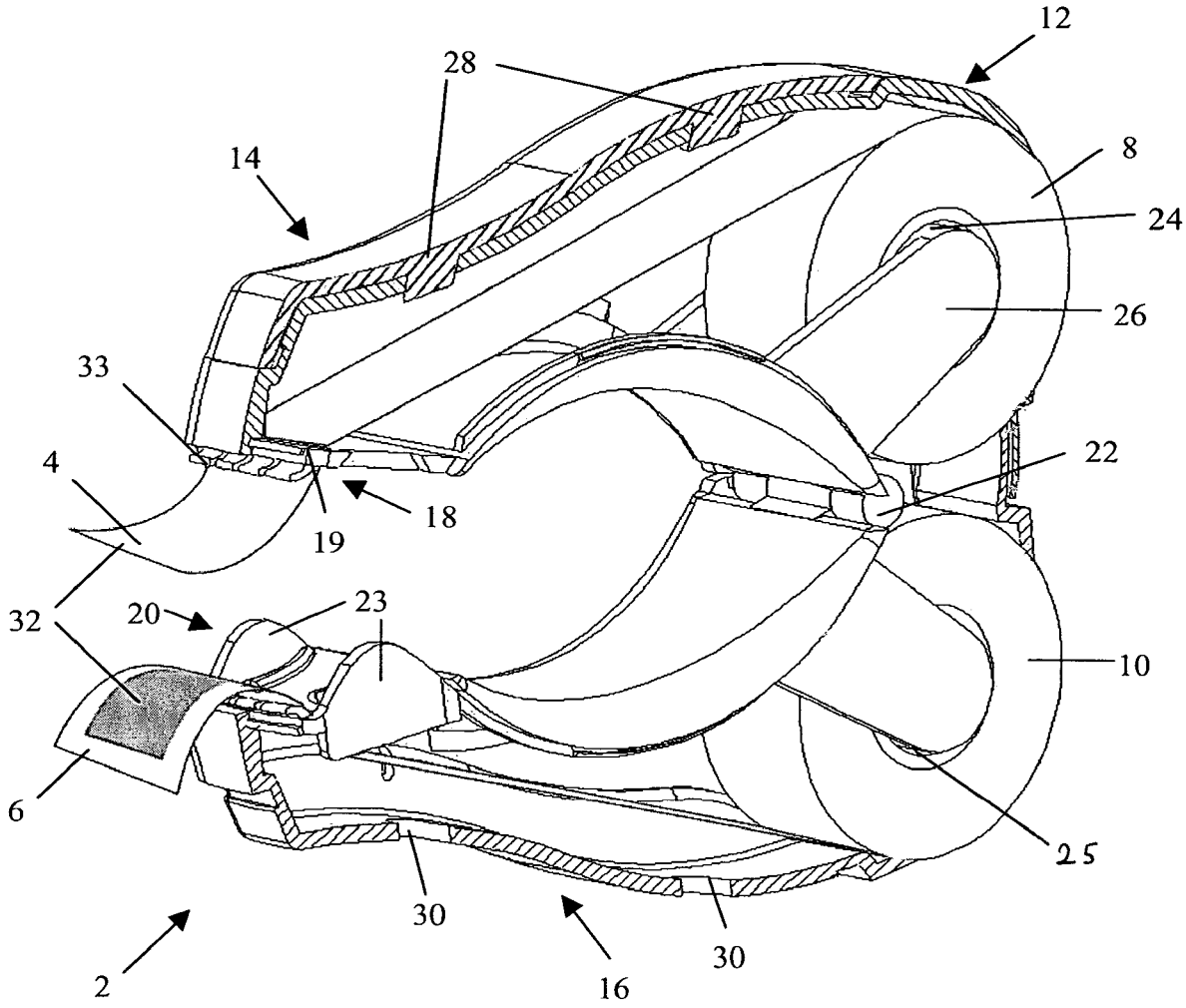
FIG. 1 is a perspective cut-away view of a first embodiment of the present invention.

Except as otherwise noted, all amounts including quantities, percentages, portions, and proportions, are understood to be modified by the word "about", and amounts are not intended to indicate significant digits. Except as otherwise noted, the articles "a", "an", and "the", mean "one or more". All documents cited are, in relevant part, incorporated herein by reference. The citation of any document is not to be construed as an admission that it is prior art with respect to the present invention.

For the purpose of this application, the term "highlighting" encompasses all treatments of hair in which one or more lock of hair is differentiated from the remainder of hair. This term includes but is not limited to treatments wherein the appearance of said lock of hair, in particular its color, is modified. Highlighting as used herein includes permanent (oxidative), semi-permanent (direct) and temporary (washable) coloring, decolorizing processes (sometimes referred to in the art as bleaching, conventional highlighting, chunking, foiling, etc) and permanent waving. Preferred treatments are "bleaching only" treatments and "bleaching plus dyeing" treatments (also referred to in the art as "permanent dyeing" or "permanent coloring"). The term "highlighting composition" refers to a composition suitable for any "highlighting" treatment as defined above. For highlighting compositions that are obtained by mixing two or more components prior to their use (e.g. oxidative hair dye composition), the term "highlighting composition" also refers to each individual component.

Throughout this description, a user may be any person who manipulates the devices according to the invention. Some non-limiting examples: (a) in the case of a person who makes a personal use of the device, for example for highlighting their own hair or the hair of a friend or relative at home, the user is that person; (b) in the case of a person who goes to a salon or elsewhere to have a cosmetic product applied to their hair by a beauty-care specialist, that beauty-care specialist is the user. For the purpose of the present application, the consumer is the person who receives the treatment.

As used herein the term "hair" to be treated may be "living" i.e. on a living body or may be "non-living" i.e. in a wig, hairpiece or other aggregation of non-living keratinous fibers. Mammalian, preferably human hair is preferred. However wool, fur and other keratin containing fibers are suitable substrates for the compositions according to the present invention.

The term "hand-held" as used herein means that that the device can be held and manipulated by the user. Preferably, the device is sufficiently small and light to be held in a single hand of the user.

As used herein, the term "applied" when referring to a composition is to encompass, but is not limited to the terms coated, absorbed, adsorbed, trapped and adhered.

The term "re-usable" as used herein means that a new roll of tape of barrier material may replace an exhausted one within the device. The devices according to the present invention are preferably re-usable.

As used herein the term "internal", when referring to the surface of a roll of tape, refers to the surface of the tape facing the center of the roll. The term "external" refers to the opposite surface of the tape.

Essential and optional elements of the methods and implements according to the present invention will now be described in detail by reference to various exemplary embodiments of the invention, several of which are also illustrated herein, wherein like numerals indicate the same elements throughout the description.

Device Comprising Two Rolls

The exemplary device of FIG. 1 describes a two-rolls device 2 capable of simultaneously dispensing two tapes of barrier material 4 and 6 to a lock of hair. The first and second tapes are respectively unrolled from a fist roll 8 and a second roll 10 contained in the body 12 of the device. An upper jaw 14 and a lower jaw 16 may include the tape dispensing means tape 18 and 20 and tape guiding means for guiding the tapes from the rolls to the dispensing means. The dispensing means may include elongated slits or exit ports 19 as shown on FIG. 1. The internal surfaces of the first and second tapes are preferably facing each other when dispensed.

The body is sufficiently small and light-weight to be held and manipulated by the user, preferably with a single hand. The part of the body containing the rolls may be held in the palm of the user, whilst the upper jaw 14 may be operated by the user's thumb and the lower jaw 16 may be operated by the user's remaining fingers, or vice versa. The upper and lower jaws may be connected by hinge means 22, which may allow the user to close the jaws (and thereby the dispensing means) on the lock of hair. Example of hinges means includes a conventional hinge on which both jaws are mounted, as shown on FIG. 1. The body and jaws themselves may also intrinsically provide hinge means if these are made partly or in totality of a flexible and/or resilient material. Conventional elastomers such as rubber may be suitable for that purpose.

Once the jaws are engaged on the lock of hair, the user may pull the device along the length of the lock of hair while keeping a sufficient pressure on the jaws to maintain a good contact between the lock of hair and the dispensed tapes. The user may use his/her free hand to help guide the lock of hair between the dispensing means 18 and 20. The device may include hair guiding means 23 to guide the lock of hair to and/or between the dispensing means. The hair guiding means may include two fins (as represented on FIG. 1) that form a canal and may be used to position the lock of hair more easily near the dispensing means.

The rolls 8 and 10 are rotatably connected to the body, and maybe supported by a rotational shaft 24 extending along the length of the rolls. The rotational shaft may be a reel, as represented for the first roll 8 in FIG. 1, or other suitable means known by the person skilled in the art, such as gearing. In the device of FIG. 1, the spindle is connected to the body by a support arm 26.

The rolls may be initially and permanently secured to the device when sold. This has the advantage that the user does not have to manipulate the rolls, on which a chemical may already be applied, but a new device has then to be bought after the tapes have been exhausted.

On the other hand, each roll may be removably connected to the body and replaceable by another roll. For example, when the device is exhausted instead of having to buy a new device, the rotational shaft 24 may be adapted to be manually disengaged from the support arm 26 and a new roll may be manually inserted to replace an exhausted roll. Another advantage is that a partially used roll may be replaced by a different roll and saved for later use.

The housing of the rolls may be open, permanently closed or openable. An open housing is advantageous if the device is going to be extensively used, for example in a salon. In this case, the rolls may have to be regularly replaced and an open housing may allow the user to quickly access and replace the rolls inside the device. It may also be necessary to manually position the free end of the tape to the dispensing means when the device is first used or during use if the tape end withdraws into the device.

A closed housing containing the rolls may be advantageous to protect these from external interference. Also, a closed body may be helpful to protect the user and the external environment from accidental release of the highlighting composition if the device contains the highlighting composition or its components.

An openable housing (as shown in FIG. 1) is a compromise between the open and closed housing discussed above. FIG. 1 shows catches 28 on the upper jaw and guide ports 30 on the lower jaw that may hold an openable housing.

As represented in FIG. 1, the highlighting composition 32 (or one of its components) may be applied on the internal surfaces of the tapes forming the rolls, and therefore dispensed simultaneously as the tapes to the lock of hair.

The dispensing means 18 and 20 (which may be or include slits 19 as shown in FIG. 1), are preferably of a size suitable to allow easy flowing of the tapes. The dispensing means may include gripping means to maintain tension in the tape inside the device. This may be useful to maintain the tape in a correct position inside the device and also may help to prevent the free end of a tape from retracting inside the device. Examples of gripping means include one-way rollers or a flexible valve that opens as the tape is pulled from the device and closes when the tape is not being dispensed. The dispensing means may also include at least one lip 33 for a better application of the tapes to the lock of hair. The lips may have a sharp edge to help cutting the tapes at the desired length.

Figure 2:
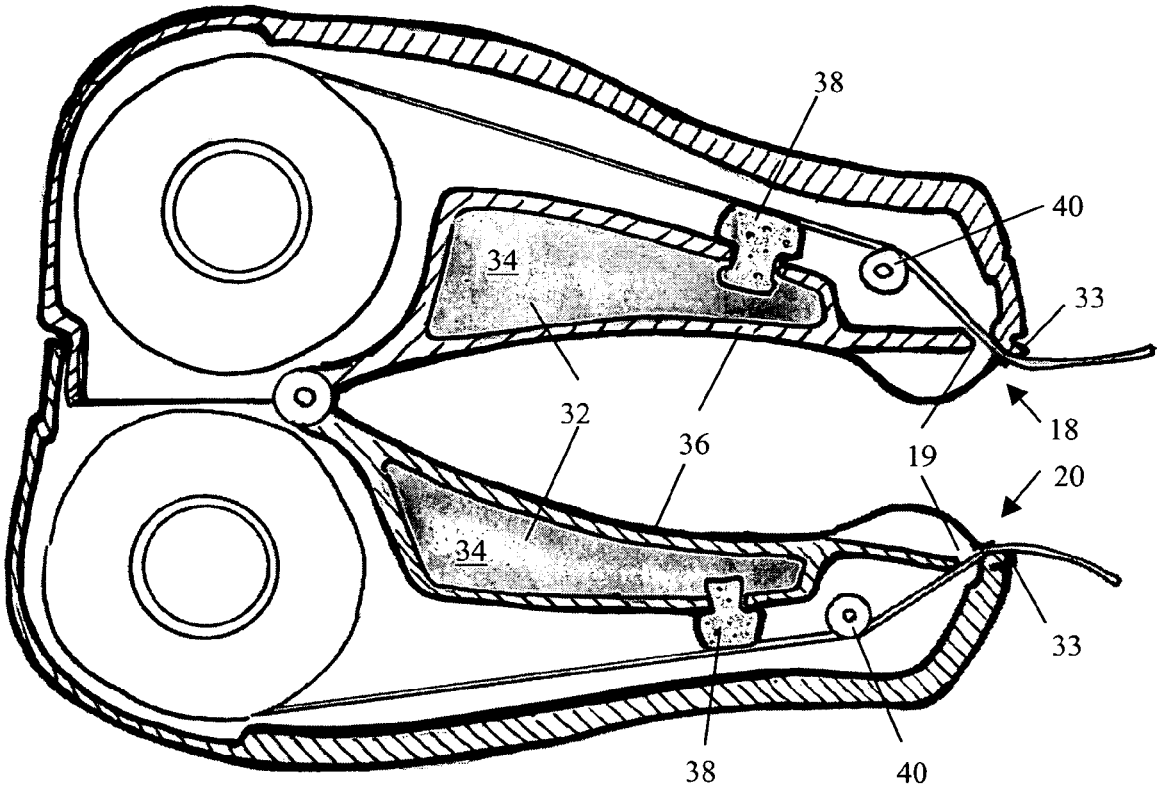
FIG. 2 is a sectional view of a second embodiment of the present invention.

FIG. 2 shows an alternative two-roll device comprising reservoir means 34 for storing the highlighting composition before it is applied to the tapes. The reservoir means 34 of the embodiment of FIG. 2 are spaces located in the upper and lower jaws. These spaces may be filled and sealed during manufacture of the device or may be re-fillable, for example by pouring the composition via an opening that may be sealed with a plug or a cartridge. The walls 36 of the reservoir are preferably resistant and leak-proof to the compositions stored therein.

The highlighting composition, which in this embodiment is preferably a flowable (or liquid) composition, can be applied to the tapes via a highlighting composition dispensing means 38, which may be a porous mass as represented in FIG. 2. The porous mass may for example be a sponge or felt tip. Other examples of highlighting composition dispensing means include a nozzle, a valve, a single hole or a mesh.

In this embodiment, the highlighting composition may be a two-component composition, wherein the first component is stored in one reservoir and the second component is stored in the reservoir situated in the other jaw.

A wheel 40 may be used to guide the tape towards the dispensing means.

Figure 3:
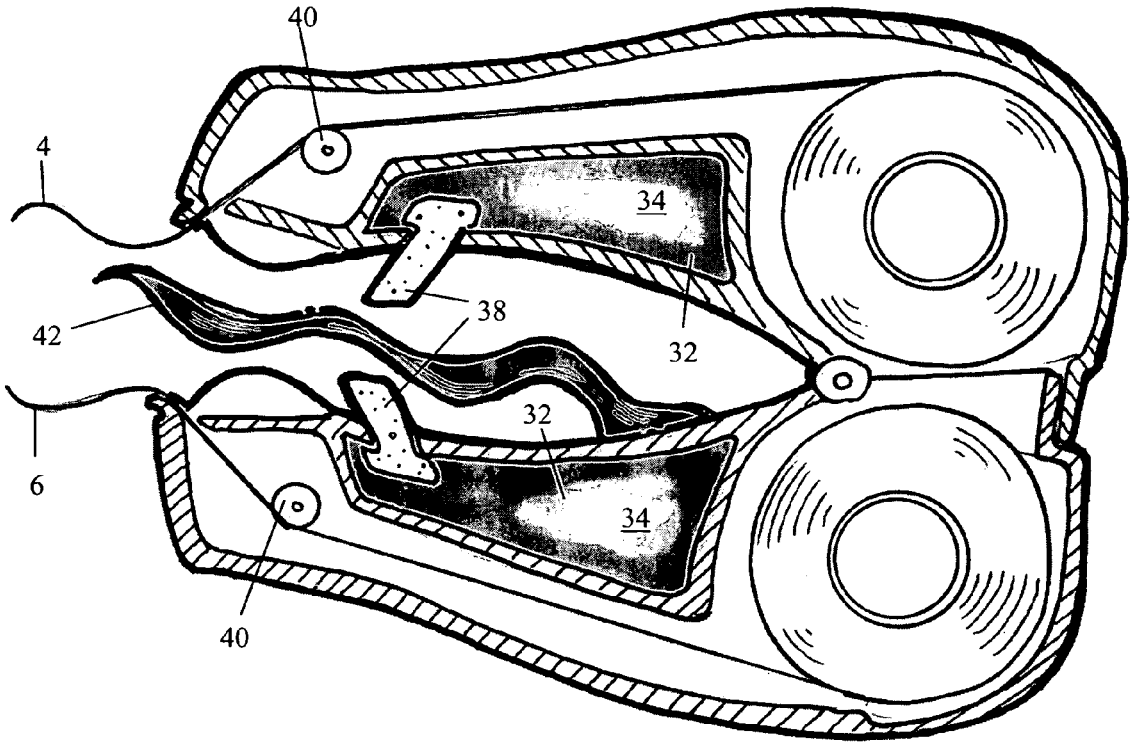
FIG. 3 is a sectional view of a third embodiment of the present invention.
Figure 4:
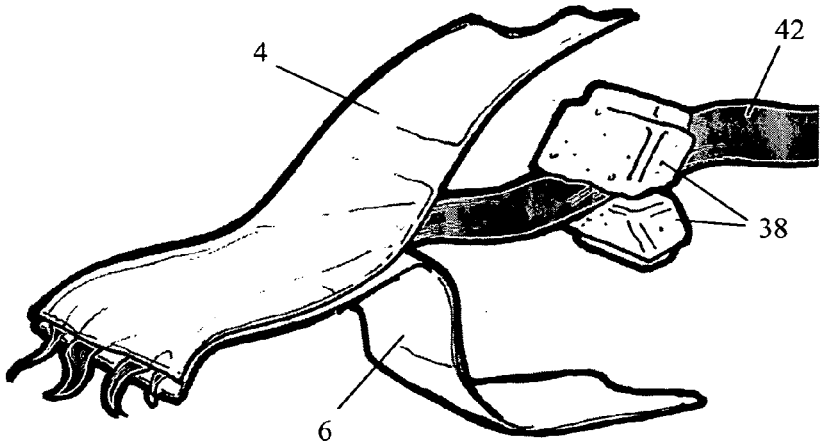
FIG. 4 is a perspective cut-away view of a detail of the embodiment of FIG. 3, wherein the lock of hair is engaged in the device.

FIG. 3 shows a third embodiment comprising reservoir means for the highlighting composition as in FIG. 2, but wherein the highlighting composition 32 (or its components in the case of a two-component compositions) is first applied to the lock of hair 42, which is subsequently enclosed between the internal surfaces of the tapes. This embodiment may be in some cases more advantageous than the embodiment of FIG. 2, for example when the highlighting composition is difficult to apply on the surfaces of the tapes. FIG. 4 is a perspective cut-out view of this third embodiment, showing how the lock of hair is first dispensed with the highlighting compositions and then sandwiched by the tapes of barrier material.

Figures 5, 6, 7:
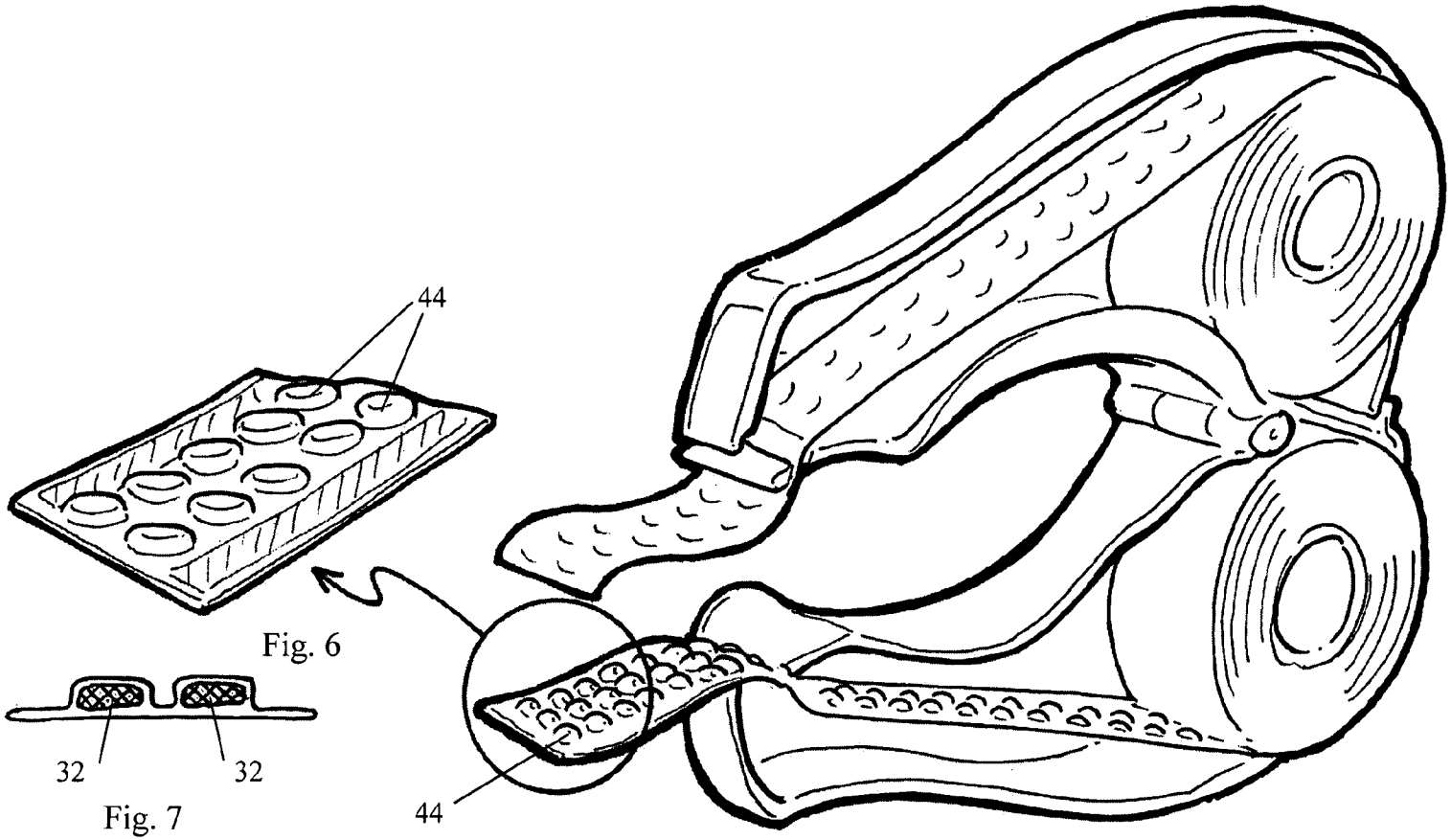
FIG. 5 is a perspective view of a fourth embodiment of the present invention.
FIG. 6 is a perspective view of a detail of the embodiment of FIG. 5 as indicated by the arrow on FIG. 5.
FIG. 7 is a cross-sectional view of the detail shown in FIG. 6.

FIG. 5 shows a fourth embodiment similar to the embodiment of FIG. 1 but wherein the highlighting composition is trapped in discrete cells 44 that may be ruptured, for example by the application of a pressure. These cells are discussed in more detail below.

All cells may be filled with the same highlighting composition or with different compositions. In case of a two-component highlighting composition, the cells may be alternatively and regularly filled with each component, which may allow excellent mixing of the components when the cells are ruptured. FIG. 6 and FIG. 7 show a close-up view of one tape and a cross-section view of the cells, the number of cells per row may greatly vary, for example from one to one hundred, preferably from 2 to 10 for ease of manufacture.

Figure 8:
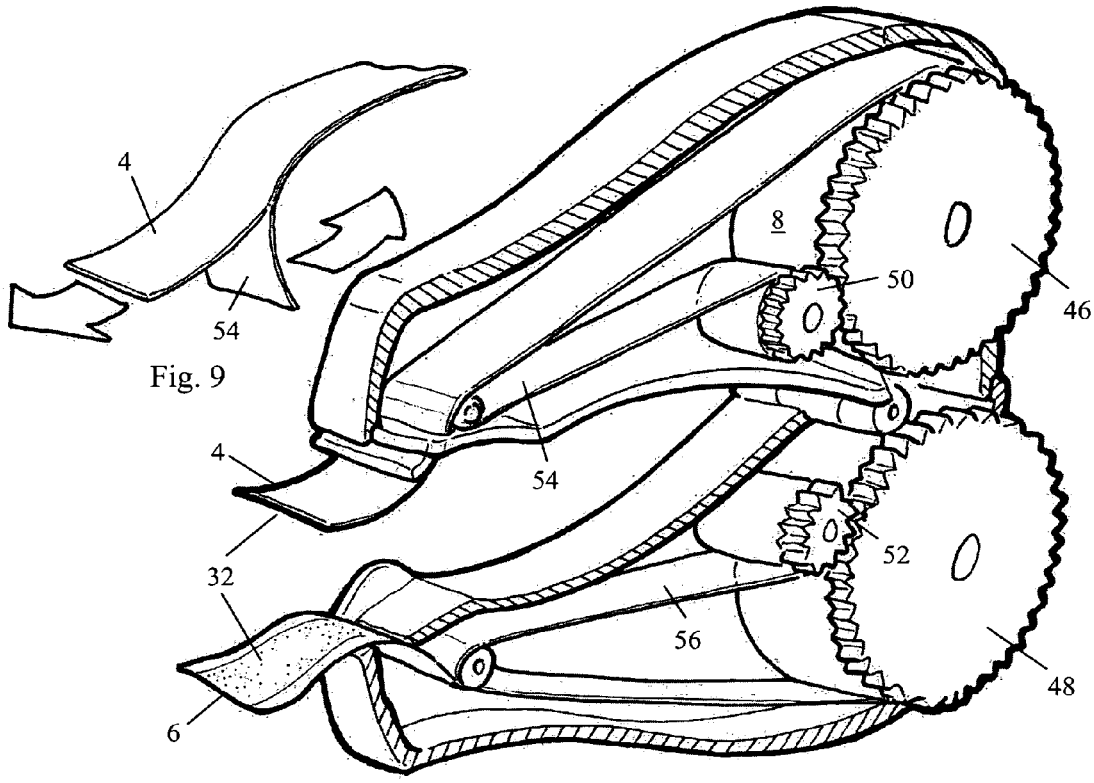
FIG. 8 is a perspective view of a fifth embodiment of the present invention.

FIG. 8 shows a fifth embodiment wherein the roll 8, respectively 10, is supported by the rotational shaft on which notched wheels 46, respectively 48, is mounted. The dispensing of tape 4 (respectively 6) drives the rotation of roll 8 (respectively 10), which is supported by rotational shaft of notched wheel 46 (respectively 48). The notched wheel 46 (respectively 48) cooperates and drives the rotation in an opposite direction of notched counter-wheels 50 (respectively 52).

In this fifth embodiment, the highlighting composition (or its components) 32 is preferably applied between the tapes of barrier material 4, 6 and their peelable backing tapes 54, 56. In this way, the highlighting composition is isolated until just before the moment when the tapes 4, 6 are dispensed. The counter-wheels 50 and 52 drive the rolling-up of the backing tapes 54, 56 on the rotational shafts (e.g. a spindle) on which these counter-wheels are mounted. Thus, only the barrier material tapes and the highlighting composition are dispensed, the backing tapes being safely and cleanly stored inside the device. FIG. 9 is a perspective cut-away view showing how the backing tapes and the barrier tapes separate.

The backing tape may also serve to protect the external surface of the barrier tape from contamination by a composition applied on the internal surface of the barrier tape material when the barrier tape is in a rolled form.

Figures 10, 11:
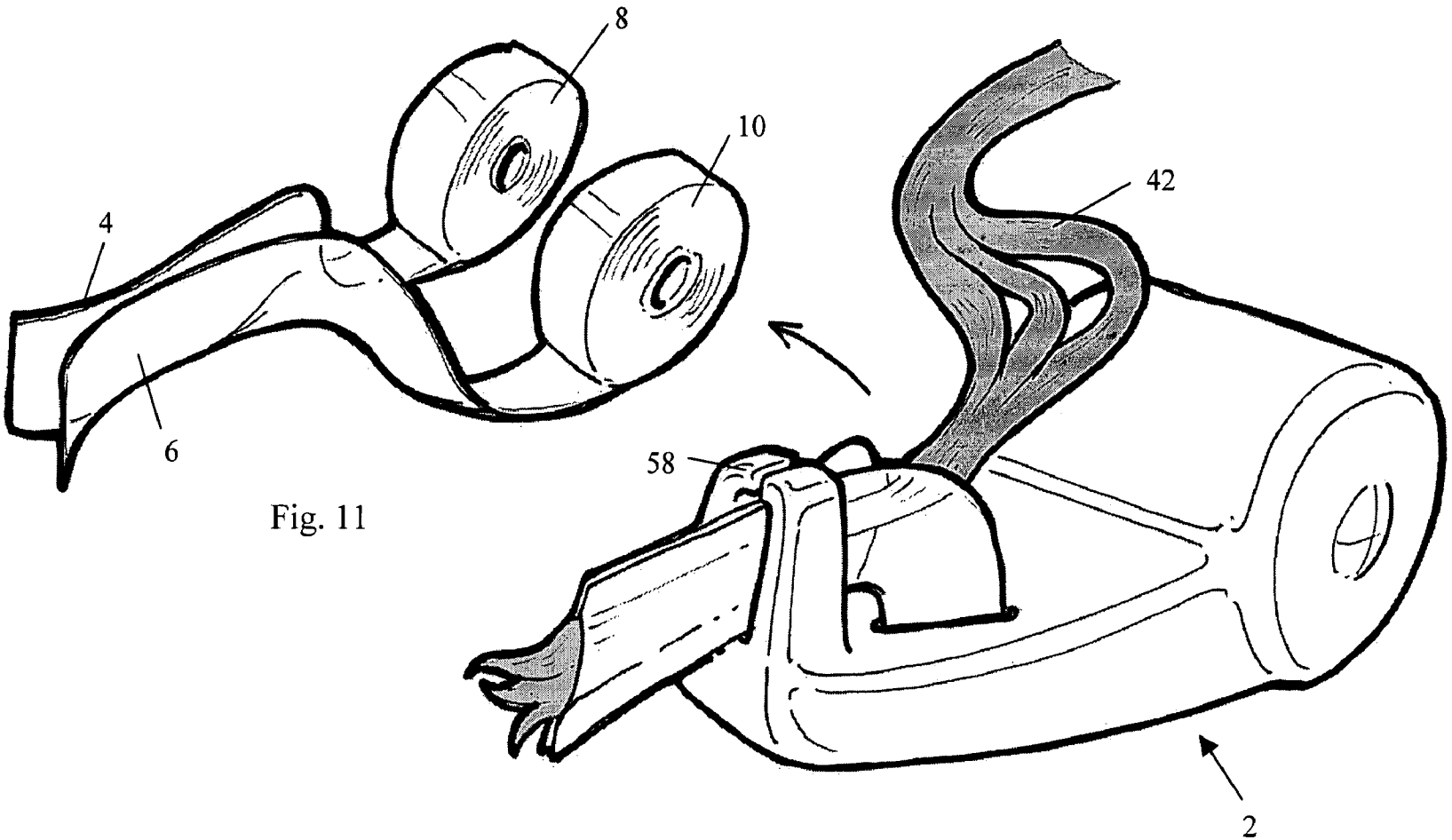
FIG. 10 is a perspective view of a sixth embodiment of the present invention.
FIG. 11 is a perspective cut-away view showing a possible layout of the tapes inside the embodiment of FIG. 10.

A sixth embodiment is shown in FIG. 10, wherein the two rolls 8 and 10 (the position of which inside the device 2 is shown in FIG. 11) share the same rotational shaft, which maybe a spindle. When the tapes 8 and 10 are unrolled, their respective internal surfaces initially face the same direction instead of facing each other as in the embodiments previously discussed. Tape guiding means (which may include a wheel or a curved channel) may be provided to change the orientation of the tapes, which are dispensed with their internal surfaces substantially facing each other.

Pinching means 58, which may be an open slit as shown on FIG. 10, may be provided to bring the delivered tapes 4, 6 and the lock of hair in closer contact. The highlighting composition may be applied on the tapes or directly on the hair following any of the methods described for the other embodiments discussed herein. The highlighting compositions may be for example already applied to the rolled tapes inner surfaces.

Device Comprising a Single Roll

Figures 12, 13:
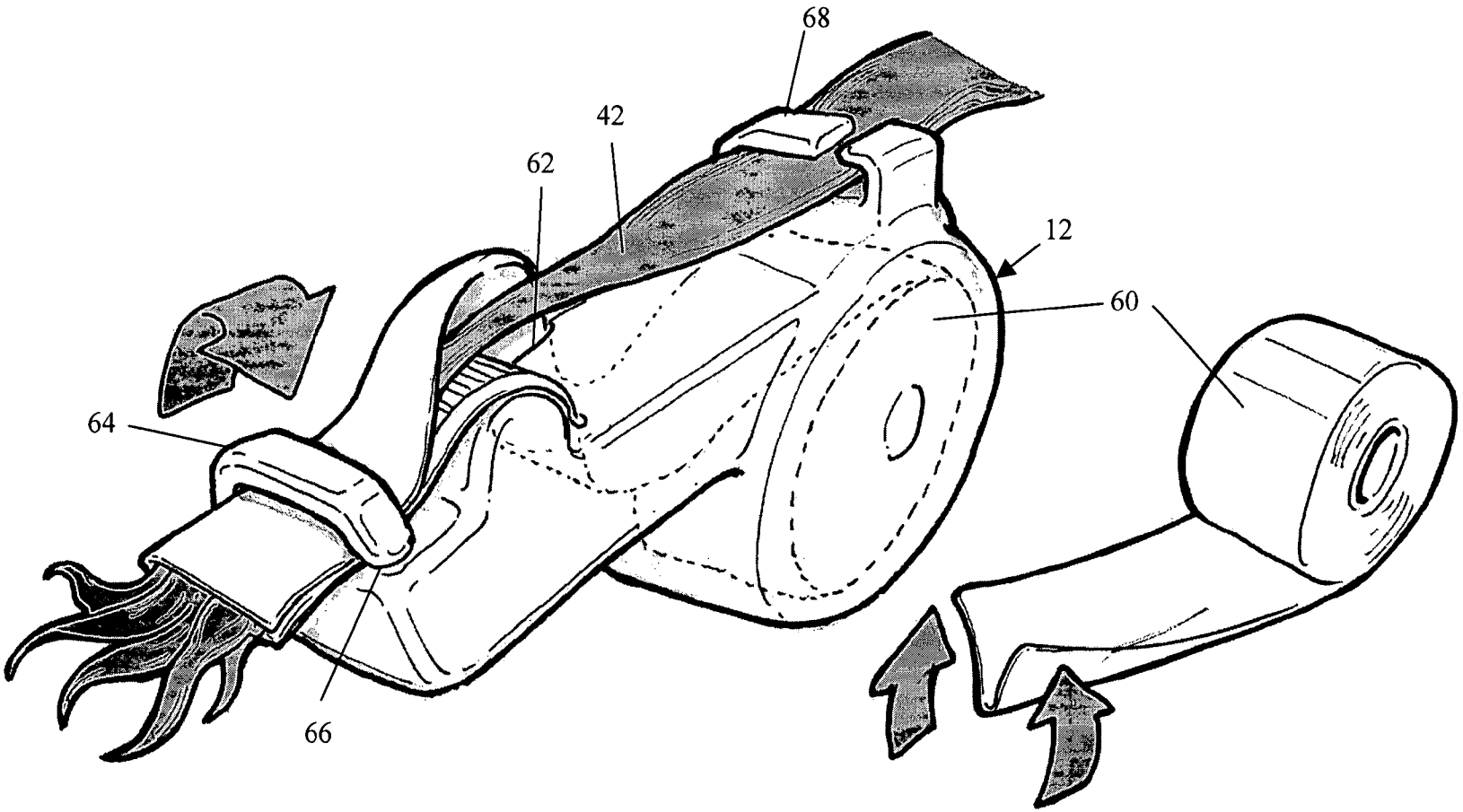
FIG. 12 is a perspective view of a seventh embodiment of the present invention.
FIG. 13 is a perspective cut away view showing a possible layout of the tape in the embodiment of FIG. 12.
Figure 17:
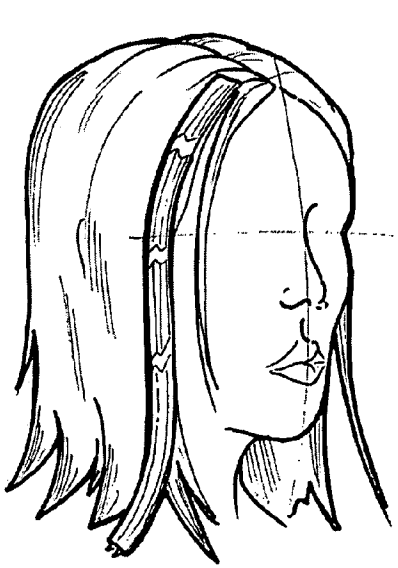
FIG. 17 is an isometric view wherein the device of FIG. 14 has been completely pulled down the lock of hair and the tapes completely delivered along the whole length of the lock of hair.
Figure 16:
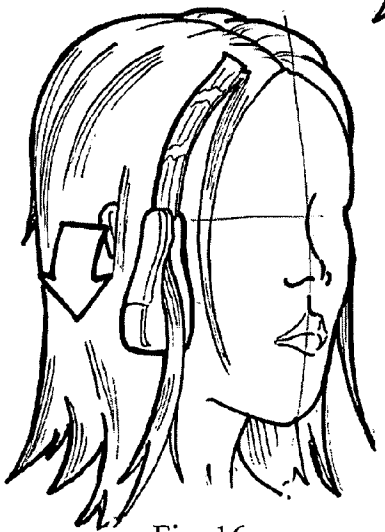
FIG. 16 is an isometric view wherein the device shown in FIG. 14 has been pulled half-way down and the tapes simultaneously delivered to the first half of the lock of hair.
Figure 15:
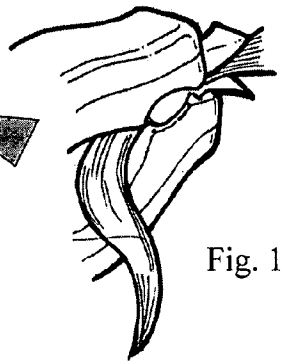
FIG. 15 is an isometric close-up view of the device and the lock of hair of FIG. 14.
Figure 14:
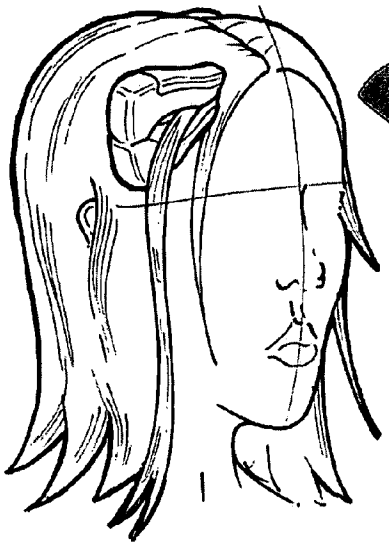
FIG. 14 is an isometric view of a consumer showing how a device such as the device of FIG. 1 may be initially engaged on the lock of hair. The hand of the user is not represented.

FIG. 12 shows a seventh embodiment of the present invention wherein a single roll is used. The hand-held device of FIG. 12 comprises a body 12, which may be held and manipulated by the user, a single roll of a tape of barrier material 60 rotatably connected to said body, and dispensing means 62 for dispensing said tape to a lock of hair 42. The tape preferably can be folded so as to enclose the lock of hair to be treated.

The roll 60 may be supported by a rotational shaft (e.g. a spindle) connected to the body 12. The dispensing means may be a curved slit that dispenses the tape in a pre-folded shape, and which eases the subsequent complete folding or wrapping around the lock of hair. The dispensing means may further include a clip 64, which may include an opening 66 as shown in FIG. 12 or which may be fitted with a hinge to make it manually openable and closable. The tape may comprise a folding line along its longitudinal axis to further facilitate its folding around the lock of hair. If the barrier material is inherently foldable without difficulty by the user, a folding line or other further folding means may not be useful.

In the case of a two-component highlighting composition, the tape may be longitudinally and equally divided into two areas on which each component is applied, so that when the tape is folded the two components are facing each other and can react to form the highlighting composition.

Hair guiding means 68 may also be provided to help position the lock of hair relative to the dispensed tape. Other features, which have already been discussed for a two-roll device, such as one or more reservoir means and a peelable backing for the tape, may also be used for a device comprising a single roll.

Barrier Material

The devices according to the present invention comprise at least one roll of a tape of barrier material. As used herein, the term "barrier material" means a material that can isolate the highlighting composition applied on the lock of hair from its environment, especially the remainder of the consumer's hair and the user's hand or clothes. The barrier material should therefore be isolating enough to substantially prevent leaking or diffusion of the highlighting composition, at least during the length of the treatment.

The tape is preferably continuous and may comprise serration lines at regular intervals along its length, for example every 5 cm or 10 cm, which may allow the user to easily cut a tape of the required length, for example with the hand or with an implement such as a pair of scissors or a stiletto (thin blade). The tape's initial length (when new) may be at least one meter long and preferably at least several meters long so that one device is sufficient for a complete highlighting treatment of a consumer's hair without having to change the device or replace the tape in the device. When more than one tapes are delivered simultaneously, these tapes preferably have the same length.

The thickness of a tape may advantageously be kept to the minimum required so that a longer length of tape can be rolled for a given roll's diameter. The device being hand-held, the roll's initial diameter is preferably kept at a convenient size (preferably less than 20 cm, more preferably less than 15 cm, even more preferably less than 10 cm, still more preferably between 5 cm and 10 cm). In general, the more leak-proof/impermeable the barrier material is, the lower the required thickness of the tape is. The required thickness of the tape will depend on the barrier material used and the type of highlighting compositions used. Typical thickness will range from 0.01 mm to 2.5 mm, preferably from 0.05 mm to 2.0 mm, more preferably from 0.1 mm to 1.5 mm. The width of the tape may be adapted to the size of the lock of hair to be treated. A tape's width of between 10 mm to 100 mm may be usually suitable, but maybe larger when the tapes needs to be folded to enclose the lock of hair. For example, in a single roll embodiment the tape's width may be twice as large. The dimensions (e.g. thickness, width) of the tape are preferably uniform along its whole length.

The barrier material may be, but is not limited to, paper, plastic, fabric, rubber, metal foil, natural or synthetic woven or nonwoven material, polymeric films such as thermoplastic films of polyolefins, polyesters, polyamides or polymer blends, composite materials such as a coated nonwoven or a film-coated nonwoven material, ceramics or any combinations thereof in a laminate. Naturally, the tape of barrier material is sufficiently flexible to be formed in a roll. Polymeric films are preferred, for example polyethylene terephthalate, as they may be easily extruded or cast and rolled in rolls, can easily be combined with other materials, and are relatively inexpensive. Other preferred materials are metallic foils, preferably aluminum foil. Metallic foils are excellent barrier material and can be laminated in very thin tapes. Further preferred materials are inorganic oxides, preferably ceramics such as aluminium and silicon oxides, which can be deposited as thin films onto polymer substrates.

The rolls preferably include a stiff inner ring as support, said ring being in contact with the rotational shaft. The tape may be a laminate comprised of several layers, for example when it is desirable to have a different texture on the internal surface and the external surface of the tape. For example, the internal surface may be porous to absorb or retain the highlighting composition while the external surface may impermeable to the highlighting composition.

When the rolls of tape of barrier material comprise the highlighting composition before the tapes are dispensed, the barrier material should in addition be chemically inert with the highlighting composition or its components for a sufficient amount of time. The barrier material is preferably inert in relation with the highlighting composition or its components prior to or during the treatment.

When two or more tapes of barrier material are dispensed, these tapes may be the same or different. In the case of the components of a two-component highlighting composition being separately applied on the surface of two different tapes forming the rolls, it may be advantageous to have a stronger barrier material for the tape serving as carrier for the more reactive or aggressive component (e.g. hydrogen peroxide component in an oxidative dye composition). If the compositions applied on both tapes are identical, the barrier materials and the structure (e.g. length, thickness, etc.) of the tapes are preferably identical.

The tapes may also comprise a water-soluble material that dissolves upon rinsing (e.g. PVA), thus facilitating the release of the implements when the treatment is finished.

As shown on FIG. 8, a composition may be enclosed between the tape of barrier material on one side and a backing tape on the other side. This enclosed composition may be the highlighting composition itself, one of its components or another type of composition, for example a sticky composition which will increases the adherence of the dispensed tapes.

The tapes may include an adhesive component so that once dispensed the tapes are sufficiently adhesive to remain in contact with the lock of hair without having the user to hold them in contact with the hair lock. However, they should not be so adhesive as to be painful or inappropriately difficult to remove from the lock of hair once the highlighting treatment is completed. Mechanical means such as clips may be provided to maintain the hair in contact with the lock of hair during the treatment.

Highlighting Composition

The highlighting compositions used may depend on the background color of hair, the desired result, and the duration of the highlight sought by the consumer (e.g. permanent, semi-permanent or washable). Some highlighting services, especially on clients with lighter hair color or those who desire less contrast in their highlights, are performed using oxidative hair coloring techniques and products. These may be performed using oxidative tints that have little or no oxidative dye precursors and that are alkalized with relatively high levels of common hair dye alkalizers (generally, but not limited to, ammonium hydroxide and monoethanolamine). These are generally combined at the time of the service with high-volume peroxide developers to form an unstable highly alkalized peroxide composition that can effectively decolorize hair to a limited extent. By "high volume peroxide developer" we mean, as generally understood in the art of hairdressing, an aqueous peroxide solution, suspension, or emulsion that contains hydrogen peroxide in an amount greater than 30 volume (approximately 9.0% w/w). Higher levels of oxidative dye precursors (couplers and developers) in addition to the alkalizing agent may also be used if a further coloring effect is desired. Lower levels (e.g. 6.0% w/w) may also be used.

Highlighting compositions are usually either directly applicable or require a mixing step between two components immediately prior to use. For example, oxidative hair dyes require mixing an oxidizing component with an alkalinizing dye component prior to use, as the mixed composition is not stable and decomposes rapidly.

The highlighting compositions that may be used with the device according to the present invention may be provided in any suitable form, such as an aqueous composition, a paste, a viscous liquid, a powder, a gel or an oil-in-water emulsion.

The highlighting composition may be contained in the device prior to being dispensed to the lock of hair. For example, the highlighting composition may already pre-applied be on the surface of the tapes forming the rolls. In this case, the highlighting composition may be a thickened solution comprising a salt-tolerant thickener and/or oil-in-water emulsions. The compositions applied on the tapes may preferably be in the form of a gel, which provides good adhering properties to the products and a source of water that may facilitate the mixing of the reactants comprised in the first and second components. Hydrogels are especially preferred. The amount of substance applied on the tapes will depend upon the size and capacity of the piece of material, concentration of the actives, and the desired end results.

The highlighting composition may also be contained in reservoir means for storing the highlighting composition separate from the tapes until the tapes are dispensed. In this case the device, may also comprise highlighting composition dispensing means for applying the highlighting composition to a substrate, wherein said substrate is at least one of the tapes, preferably the internal surface of each tape, or the lock of hair to be highlighted. An examples of highlighting composition dispensing means is a porous mass as represented in FIG. 2, which may be a sponge or felt tip. Other examples of highlighting composition dispensing means include nozzles, valves, single holes or meshes.

The device may also be used to dispense the barrier material only, the highlighting composition being dispensed by the user without the help of the device. For example, the user may first apply a flowable composition to the lock of hair using a brush and dispense the barrier material afterwards.

The highlighting treatment may optionally be activated, for example by heat, water- or pressure. In the case of water-activation, highlighting composition in the form of dry powder may be used. For example, the lock of the hair may be wetted prior to being wrapped in a barrier material in which the powder is applied or the lock of hair may be wetted after the barrier material has been dispensed if the barrier material is permeable to water.

In case of two components composition, an activation step may be used to start the reaction between the first and second components. For example, pressure-activation may take place if the components are trapped in plastic bubbles that are easily frangible, such as polyethylene or polypropylene "CARMA" bubbles, supported by a backing made of a plastic material as shown on FIG. 5-7. CARMA is an acronym which stand for "Consumer Activated Rupturable Multi-cell Applicators", a film technology for delivering product to a surface. The product is trapped in closed cells that deliver the trapped product to the surface when ruptured by pressing with a sufficient strength the barrier material. The components contained in the cells may then mix and form the highlighting composition.

Methods of Use

The present invention is also directed to a method for applying a barrier material to a lock of hair to be highlighted, said method comprising the steps of:

i) dispensing the highlighting composition to the lock of hair, ii) simultaneously unrolling and dispensing to the lock of hair one or more tapes of barrier material, wherein step i) and ii) can take place simultaneously or subsequently.

This method provides a quick, easy and cheap method of highlighting hair.

The present invention is also directed to a method for applying a tape of barrier material to a lock of hair to be highlighted, said method comprising the steps of:

i) providing a device according to the present invention, ii) engaging the lock of hair with the dispensing means of the device, iii) simultaneously unrolling and dispensing to the lock of hair one or more tapes of barrier material by moving the device along the lock of hair to be highlighted, iv) disengaging the lock of hair from dispensing means.

FIG. 14 to 17 illustrate these methods (the hand of the user is not represented). In this example, the user may pull a small length of tape from each of the two dispensing means (e.g. slits), a highlighting composition being pre-applied on the internal surfaces of said tapes. The user then engages the jaws at the roots of the lock of hair to be highlighted, getting as close as possible to the scalp. When the jaws are closed, the lock of hair is enclosed between the two tapes and the highlighting composition contacted with the lock of hair. Alternatively, the user may grasp the free ends of the two tapes and manually press them together to enclose the lock of hair. The device is then pulled to dispense the barrier material along the rest of the length of the lock of hair to be treated. It may be more practical to pull the device from the base of the lock to its free end, but it is also possible to start the dispensing of the barrier material at the free of the lock of hair and then pull the device in the opposite direction towards the root. When the desired length of hair has been enclosed, the dispensed tapes is separated from the device by cutting or tearing. The barrier material is left in place for the duration of the treatment, which may be activated, for example water activated, and is then removed from the lock of hair. The process is repeated until no other locks of hair to be treated remain.

Method of Manufacture

The devices according to the present invention may be made using conventional material and by conventional means, for example plastic pieces obtained by injection molding.

The tapes may be made using conventional material and by conventional means. If the highlighting compositions, or any of its component, is pre-applied on a tape which is then formed into a roll, the surface of the tape receiving the highlighting composition may be preferably specifically adapted to receive this highlighting composition. For example, the surface of the tape on which the composition is applied may be specifically porous or textured to retain more easily the composition. Various methods of adhering a highlighting composition to a substrate have already been addressed in the art. For example, U.S. Pat. No. 5,891,453 and U.S. Pat. No. 5,879,691 disclose strips of clear plastic on which a hydrogen peroxide gel is coated. U.S. Pat. No. 5,845,653 and U.S. Pat. No. 5,931,168 disclose a color-altering dye powder material soluble in water and/or water-activated which is affixed to at least one side of a rigid applicator.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand-held device for applying a barrier material to a lock of hair to be treated with a highlighting composition, said device comprising:

i) a body for allowing a user to hold and manipulate the device, ii) a first roll of a tape of barrier material rotatably connected to said body, iii) a second roll of a tape of barrier material rotatably connected to said body, and iv) at least one dispensing means for dispensing said first and second tapes of barrier material to said lock of hair, said dispensing means including a first dispensing means for dispensing the first tape and a second dispensing means for disnensing the second tape, wherein the first dispensing means and the second dispensing means are connected by hinge means allowing said first and second dispensing means to be brought closer to each other by a manual action of the user, wherein said first and second tapes of barrier material are unrolled and dispensed simultaneously.

2. A device according to claim 1, wherein the highlighting composition is contained in the device.

3. A device according to claim 2 wherein the tapes and the highlighting composition are dispensed simultaneously.

4. A device according to claim 2 wherein at least one of the rolls of tape of barrier material comprises the highlighting composition.

5. A device according to claim 4 wherein the highlighting composition is applied on at least one of the surface of the tape.

6. A device according to claim 5 wherein the highlighting composition is a two-component system, wherein a first component is applied on a surface of the tape forming the first roll, and the second component is applied on a surface of the tape forming the second roll.

7. A device according to claim 1, wherein said first roll and said second roll are supported by at least one rotational shaft attached to said body.

8. A device according to claim 7 wherein said at least one rotational shaft is a spindle.

9. A device according to claim 7 wherein said first roll and said second roll are respectively supported by a first rotational shaft and a second rotational shaft, wherein said first and second rotational shafts are different.

10. A device according to claim 7 wherein said first roll and said second roll are respectively supported by a first rotational shaft and a second rotational shaft, wherein the revolution axis of said first rotational shaft and the revolution axis of said second rotational shaft are identical.

11. A device according to claim 1 wherein said dispensing means includes tape guiding means for bringing the dispensed tapes in a position wherein their surfaces face each other.

12. A device according to claim 11 wherein said device further comprises pinching means through which the lock of hair and the tapes can be passed simultaneously and wherein said lock of hair and the tapes are brought in contact with each other, the lock of hair being between the tapes.

13. A device according to claim 1, wherein the device is re-usable.

14. A device according to claim 1 wherein the device further comprises cutting means for cutting said tapes at a desired length.

15. A method for applying a tape of barrier material to a lock of hair to be highlighted, said method comprising the steps of:

i) providing a device according to claim 1, ii) engaging the look of hair with the dispensing means at the device, iii) simultaneously unrolling and dispensing to the lock of hair the tapes of barrier material by moving the device along the lock of hair to be highlighted, iv) disengaging the lock of hair from the dispensing means.

* * * * *